US007828122B2

(12) United States Patent
Utsunomiya

(10) Patent No.: US 7,828,122 B2
(45) Date of Patent: Nov. 9, 2010

(54) VIBRATION DAMPING DEVICE FOR AN ELEVATOR

(75) Inventor: Kenji Utsunomiya, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 584 days.

(21) Appl. No.: 11/917,779

(22) PCT Filed: Sep. 9, 2005

(86) PCT No.: PCT/JP2005/016591

§ 371 (c)(1),
(2), (4) Date: Dec. 17, 2007

(87) PCT Pub. No.: WO2007/029331

PCT Pub. Date: Mar. 15, 2007

(65) Prior Publication Data

US 2009/0026674 A1 Jan. 29, 2009

(51) Int. Cl.
*B66B 1/34* (2006.01)

(52) U.S. Cl. ..... 187/292; 187/393; 318/623

(58) Field of Classification Search ..... 187/292, 187/391, 393, 409, 410; 318/116, 611, 623
See application file for complete search history.

(56) References Cited

U.S. PATENT DOCUMENTS

| | | | | | |
|---|---|---|---|---|---|
| 5,811,743 | A * | 9/1998 | Kohara et al. | ..... | 187/393 |
| 6,065,569 | A * | 5/2000 | Fuller | ..... | 187/345 |
| 6,305,502 | B1 * | 10/2001 | He et al. | ..... | 187/292 |
| 6,474,449 | B1 | 11/2002 | Utsunomiya et al. | | |
| 6,494,295 | B2 | 12/2002 | Grundmann | | |
| 6,959,787 | B2 * | 11/2005 | Husmann | ..... | 187/292 |
| 7,314,119 | B2 * | 1/2008 | Husmann et al. | ..... | 187/292 |
| 2002/0179377 | A1 * | 12/2002 | Higaki et al. | ..... | 187/292 |
| 2003/0226717 | A1 * | 12/2003 | Husmann | ..... | 187/292 |

FOREIGN PATENT DOCUMENTS

| | | | |
|---|---|---|---|
| JP | 5-319739 | A | 12/1993 |
| JP | 8-40673 | A | 2/1996 |
| JP | 2003-104655 | A | 4/2003 |

* cited by examiner

*Primary Examiner*—Jonathan Salata
(74) *Attorney, Agent, or Firm*—Leydig, Voit & Mayer, Ltd.

(57) ABSTRACT

In a vibration damping device for an elevator, an actuator for generating a vibration damping force acting on an elevator car is provided in parallel with a spring for urging a guide roller against a guide rail. The actuator is controlled by a controller. The controller determines the vibration damping force to be generated by the actuator based on information from a car frame acceleration sensor for detecting horizontal acceleration of a car frame and a car cage acceleration sensor for detecting horizontal acceleration of a car cage.

4 Claims, 7 Drawing Sheets

VIBRATION DAMPING DEVICE FOR AN ELEVATOR

TECHNICAL FIELD

The present invention relates to a vibration damping device for an elevator which serves to damp lateral vibrations caused in a running elevator car.

BACKGROUND ART

In recent years, importance of technologies for damping vibration of an elevator car has been rising in association with speed-up of the elevator resulting from an increase in the number of high-rise buildings. Among such vibration damping devices, there is known one which employs detecting vibrations of a car frame with an aid of an acceleration sensor and applying a force acting reversely to the vibrations to an elevator car through use of an actuator provided in parallel with a spring on a guide portion (for example, refer to Patent Document 1).

Patent Document 1: JP 2001-122555 A

DISCLOSURE OF THE INVENTION

Problem to be Solved by the Invention

In a conventional vibration damping device constructed as described above, an actuator is provided in parallel with a spring on a guide portion, so vibration damping performance of the vibration damping device is high in a vibration mode, in which a car cage and a car frame vibrate in the same direction, but not quite high in the vibration mode, in which the car cage and the car frame vibrate in opposite directions. In particular, the car frame hardly vibrates and the car cage vibrates relatively strongly in response to an input of a disturbance in a neighborhood of a specific frequency, which is determined by a mass of the elevator car, a rigidity of a vibration-proof member, and the like. Therefore, with the conventional device having an acceleration sensor provided only on the car frame, the vibrations of the car cage can hardly be damped.

Rail displacement excitation resulting from a machining error or an installation error of each guide rail can be mentioned as one of representative disturbances causing lateral vibrations of the elevator car. A frequency included particularly predominantly in this disturbance as rail displacement excitation is empirically known to be expressed as follows, using a length L [m] of each guide rail and a speed [m/s] at which the elevator car is raised/lowered.

$$f=V/L \text{ [Hz]} \tag{1}$$

In each of conventional high-speed elevators, the frequency determined by an expression (1) is close to the frequency in the vibration mode in which the car cage and the car frame vibrate in the same direction, so the conventional vibration damping device can manage to damp lateral vibrations of the elevator car. However, as the speed when the elevator car is raised/lowered further increases, the frequency determined by the expression (1) increases and hence leads to a disturbance of a frequency which can not be damped by the conventional device efficiently. Accordingly, with a view toward speeding up the elevators, a vibration damping device having a wider vibration damping frequency range is desired.

The present invention has been made to solve the above-mentioned problem, and it is therefore an object of the present invention to proved a vibration damping device for an elevator which can manifest sufficient vibration damping performance over a wider frequency range.

Means for Solving the Problems

A vibration damping device for an elevator according to the present invention includes: a car frame acceleration sensor for detecting a horizontal acceleration of a car frame of an elevator car; a car cage acceleration sensor for detecting a horizontal acceleration of a car cage of the elevator car; an actuator provided in parallel with a spring mounted onto the car frame for urging a guide roller against a guide rail installed in a hoistway, for generating a vibration damping force applied to the elevator car; and a controller for determining a vibration damping force generated by the actuator based on information from the car frame acceleration sensor and information from the car cage acceleration sensor, to thereby control the actuator.

BEST MODES FOR CARRYING OUT THE INVENTION

Best modes for carrying out the present invention will be described hereinafter with reference to the drawings.

Embodiment 1

Figure 1:
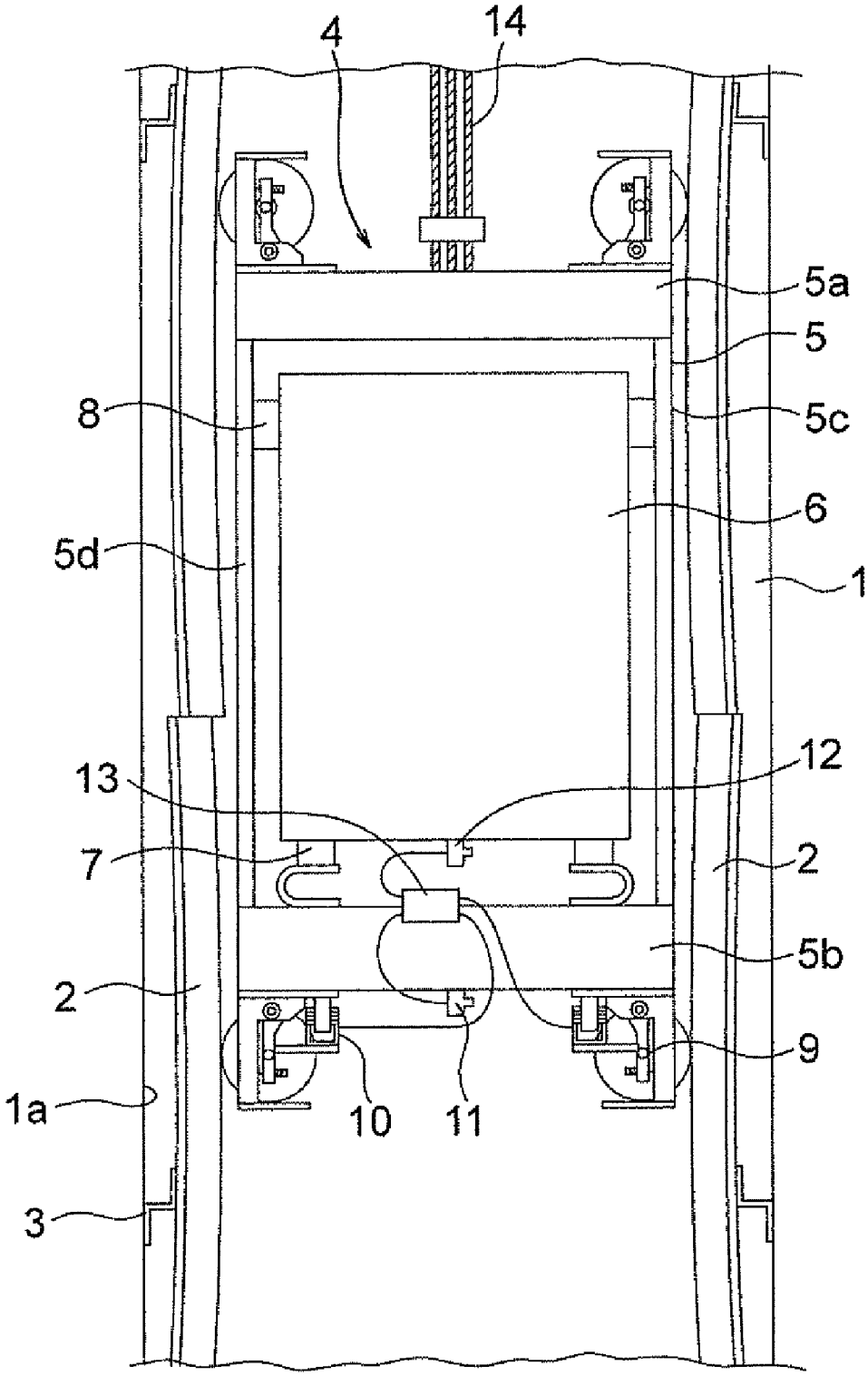
FIG. 1 is a front view showing an essential part of an elevator apparatus according to Embodiment 1 of the present invention.

FIG. 1 is a front view showing an essential part of an elevator apparatus according to Embodiment 1 of the present invention. Referring to FIG. 1, a pair of guide rails 2 are installed within a hoistway 1. Each of the guide rails 2 is constructed by splicing a plurality of rail members together in a longitudinal direction thereof. Besides, the guide rails 2 are connected to hoistway walls 1*a* via a plurality of brackets 3, respectively.

An elevator car 4 is guided by the guide rails 2 to be raised/lowered within the hoistway 1. Besides, the elevator car 4 has a car frame 5 and a car cage 6 supported inside the car frame 5. The car frame 5 has an upper beam 5*a*, a lower beam 5*b*, and a pair of vertical frames 5*c* and 5*d*. A plurality of vibration-proof members 7 are interposed between the car cage 6 and the lower beam 5*b*. That is, the car cage 6 is supported on the lower beam 5*b* via the vibration-proof members 7. A plurality of anti-vibration rubber pieces 8 for preventing the car cage 6 from tumbling are interposed between lateral faces of the car cage 6 and the vertical frames 5*c* and 5*d*, respectively.

Each of roller guide devices 9 for engaging a corresponding one of the guide rails 2 to guide the raising/lowering of the elevator car 4 is mounted at a corresponding one of both ends of the car frame 5 in a width direction thereof on a corresponding one of an upper end thereof and a lower end thereof. Each of the roller guide devices 9 mounted onto the lower beam 5*b* is provided with a corresponding one of actuators 10 for generating a vibration damping force applied to the elevator car 4.

A car frame acceleration sensor 11 for generating a signal for detecting a horizontal acceleration of the car frame 5 is fitted on the lower beam 5*b*. A car cage acceleration sensor 12 for generating a signal for detecting a horizontal acceleration of the car cage 6 is fitted on a lower portion of the car cage 6.

A controller 13 for controlling the actuators 10 is installed on the lower beam 5*b*. The controller 13 calculates a vibration damping force generated by each of the actuators 10 based on information from the car frame acceleration sensor 11 and information from the car cage acceleration sensor 12. More specifically, acceleration signals are transmitted from the acceleration sensors 11 and 12 to the controller 13, and the controller 13 calculates the vibration damping force based on those acceleration signals. The controller 13 converts a result of the calculation into a voltage signal and transmits the voltage signal to each of the actuators 10. The controller 13 is constituted by, for example, a microcomputer. The vibration damping device according to Embodiment 1 of the present invention has the actuators 10, the acceleration sensors 11 and 12, and the controller 13.

A plurality of main ropes 14 for suspending the elevator car 4 within the hoistway 1 are connected to the upper beam 5*a*. The elevator car 4 is raised/lowered within the hoistway 1 via the main ropes 14, due to a driving force of a drive device (not shown).

Figure 2:
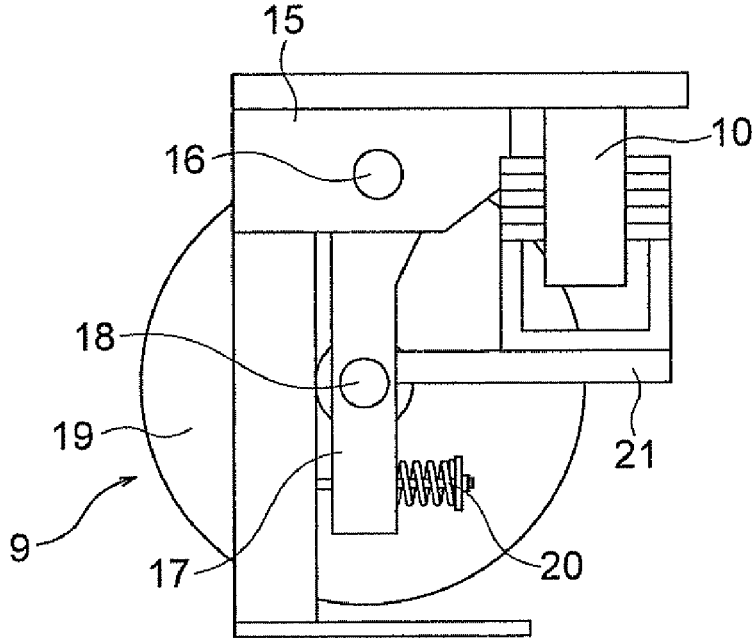
FIG. 2 is a lateral view showing each of roller guide devices of FIG. 1.

FIG. 2 is a lateral view showing each of the roller guide devices 9 of FIG. 1. The roller guide device 9 has a guide base 15 fixed to the lower beam 5*b*, a guide lever 17 rockably fitted on the guide base 15 via a rocking shaft 16, a guide roller 19 rotatably fitted on the guide lever 17 via a rotary shaft 18, and a spring 20 for urging the guide roller 19 against a corresponding one of the guide rails 2. The guide roller 19 is rolled on the corresponding one of the guide rails 2 as the elevator car 4 is raised/lowered.

An arm 21 is welded to the guide lever 17. The actuator 10 is provided between the guide base 15 and the arm 21 in parallel with the spring 20 to freely apply an urging force that is transmitted from the guide roller 19 to the guide rail 2. Employed as the actuator 10 is, for example, an electromagnetic actuator.

Figure 3:
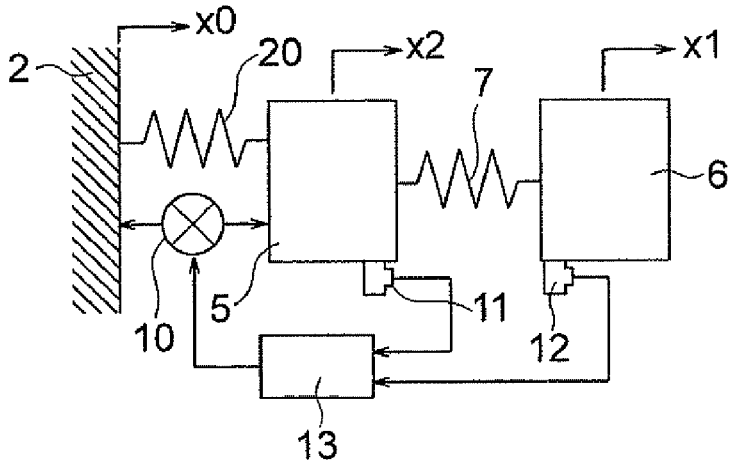
FIG. 3 is an explanatory diagram showing a relationship between an elevator car and a vibration damping device, which are shown in FIG. 1, as a two-inertia spring-mass model.

FIG. 3 is an explanatory diagram showing a relationship between the elevator car 4 and the vibration damping device, which are shown in FIG. 1, as a two-inertia spring-mass model. A method of calculating a transfer characteristic from an input to an output in the controller 13 will be described. It is one of the objects of the controller 13 to reduce a responsive characteristic $G_{x1x0}$ of the car cage 6 for a displacement disturbance x0 of the guide rail 2. An $H_\infty$ norm is used as one measure of the magnitude of $G_{x1x0}$. The $H_\infty$ norm of $G_{x1x0}$ is defined by the following expression.

$$\|G_{x1x0}\|_\infty \equiv \sup_{0\le w\le\infty}\bar{\sigma}\{G_{x1x0}(jw)\} \tag{2}$$

The right side of the expression (2) represents an upper bound of a singular value of $G_{x1x0}$. In the case of a one-input/output system (which means a relationship of a single output of x1 to a single input of x0) shown in FIG. 3, the expression (2) is represented by the following expression. The value expressed by this expression is equal to a maximum value of a gain of a Bode diagram. This value can be construed as a worst value of an output energy that is standardized at the time of entry of all sorts of energy.

$$\|G_{x1x0}\|_\infty \equiv \max_{0\le W\le\infty}|G_{x1x0}(jw)| \tag{3}$$

In the settings of the actual controller 13, the following expression, which uses a predetermined weighting function $W_S$, is given as a design objective of the controller 13.

$$\|W_s\cdot G_{x1x0}\|_\infty<1 \tag{4}$$

In an active vibration damping technology described in this embodiment, a state of oscillation arises if things go wrong, so the controller 13 must ensure stability. First of all, there is a problem in that the amplitude of uncertainty in the mass of passengers getting on and off the car cage 6 is large, namely, that the mass of the car cage 6 at the time of full load (when the car cage 6 is packed with passengers) is approximately twice as large as the mass of the car cage 6 at the time of no load (when there is no passenger in the car cage 6). It is thus one of the objects of the controller 13 to ensure stability even in the case where the amplitude of uncertainty in the mass of the car cage 6 is large.

Figure 4:
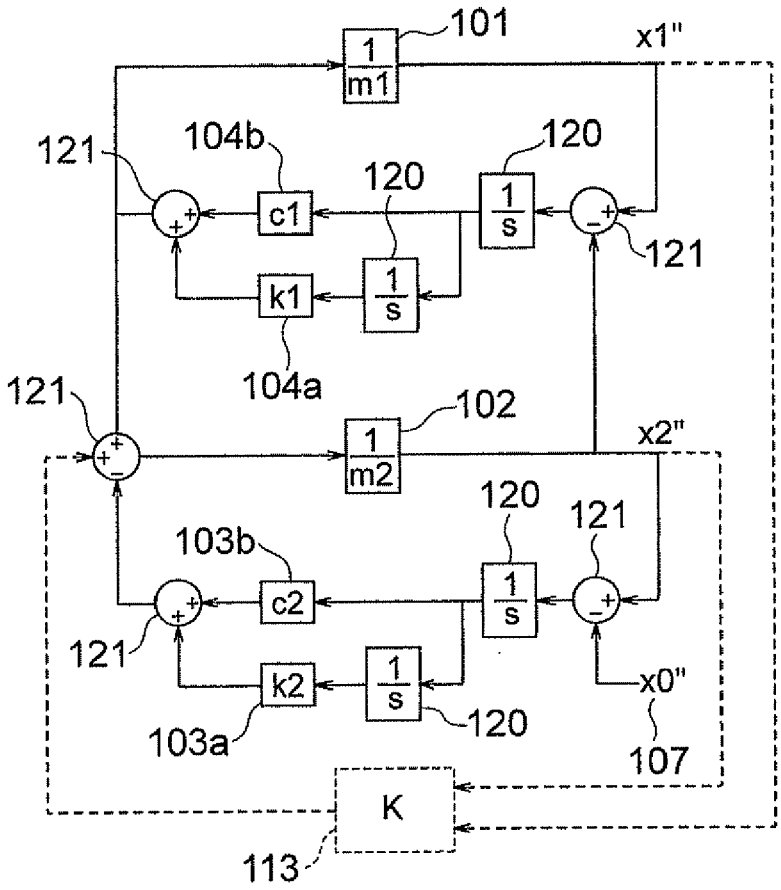
FIG. 4 is a block diagram showing a simplified model of FIG. 3.
Figure 5:
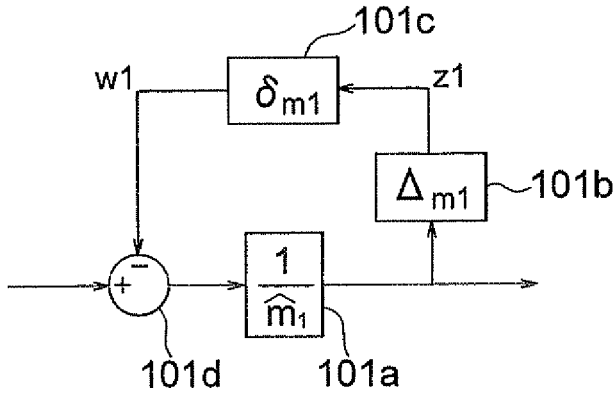
FIG. 5 is a block diagram showing uncertainty in the mass of a car cage of FIG. 1.

FIG. 4 is an explanatory diagram obtained by transforming the simplified model of FIG. 3 into a block diagram. Referring to FIG. 4, a displacement disturbance x0 of the guide rail 2 is given as a rail acceleration disturbance 107 (x0"). Referring to FIG. 5, a block 101 is a mass parameter block of the car cage 6. A block 102 is a mass parameter block of the car frame 5. A block 103*a* is a spring rigidity parameter block of the spring 20. A block 103*b* is a damping parameter block of the spring 20. A block 104*a* is a spring rigidity parameter block of the vibration-proof member 7. A block 104*b* is a damping parameter block of the vibration-proof member 7. A block 113 is a characteristic block of the controller 13. A block 120 is an integrator element, and a block 121 is an adder.

A mass $m_1$ of the car cage 6 is assumed to be expressed by the following expression. It should be noted that $\delta_{m1}$ is a perturbation element fulfilling an inequality: $|\delta_{m1}|<1$.

$$m_1\equiv\hat{m}_1+\Delta_{m1}\delta_{m1} \tag{5}$$

$\hat{m}_1$: center value $\Delta_{m1}$: uncertainty amount

In this case, the mass parameter block 101 of the car cage 6 is replaced in the form of feedback as shown in FIG. 5. Referring to FIG. 5, a block 101*a* is a mass center value parameter block. A block 101*b* is an uncertainty amount parameter block. A block 101*c* is a perturbation parameter block. A block 101*d* is an adder. A sufficient condition for ensuring stability of the system shown in FIGS. 3 to 5 for the above perturbation $\delta_{m1}$ of the mass of the car cage is expressed by the following expression, using the theorem of small gain.

$$\|G_{z1w1}\delta_{m1}\|_\infty<1 \tag{6}$$

It should be noted that $G_{z1w1}$ represents a transfer function from w1 to z1 at the time of detachment of an output end of the perturbation parameter block 101*c* in FIG. 5. That is, fulfillment of the expression (6) is given as a design objective of the controller 13.

Rubber, which exhibits relatively remarkable nonlinearity, is often used as a material of the vibration-proof member 7. Accordingly, it is one of the objects of the controller 13 to ensure stability for uncertainty in the rigidity parameter of the vibration-proof member 7 made of such a material as well.

A rigidity $k_1$ of the vibration-proof member 7 is assumed to be expressed by the following expression. It should be noted that $\delta_{k1}$ is a perturbation element fulfilling an inequality: $|\delta_{k1}|<1$.

$$k_1=\hat{k}_1+\Delta_{k1}\delta k_{k1} \tag{7}$$

$\hat{k}_1$: center value $\Delta_{k1}$: uncertainty amount

Figure 6:
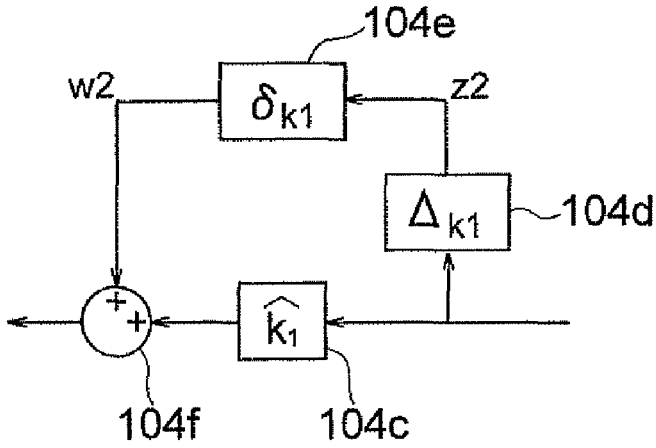
FIG. 6 is a block diagram showing uncertainty in the rigidity of a vibration-proof member of FIG. 1.

In this case, the rigidity parameter block 104*a* of the vibration-proof member 7 is replaced as shown in FIG. 6. Referring to FIG. 6, a block 104*c* is a rigidity center value parameter block of the vibration-proof member 7. A block 104*d* is an uncertainty amount parameter block. A block 104*e* is a perturbation parameter block. A block 104*f* is an adder. A sufficient condition for ensuring stability of the system shown in FIGS. 3, 4, and 6 for the above perturbation $\delta_{k1}$ of the rigidity of the vibration-proof member is expressed by the following expression, using the theorem of small gain.

$$\|G_{z2w2}\delta_{k1}\|_\infty<1 \tag{8}$$

It should be noted that $G_{z2w2}$ represents a transfer function from w2 to z2 at the time of detachment of an output end of the perturbation parameter block 104*e* in FIG. 6. That is, fulfillment of the expression (8) is given as a design objective of the controller 13.

In the simplified model shown in FIG. 3, only the spring 20 and the vibration-proof member 7 are used as elastic elements. However, elastic elements other than the spring 20 and the vibration-proof member 7 are also included in an actual elevator. For example, there are vibration modes resulting from a lack of the rigidity of members constituting the car cage 6, a lack of the rigidity of a member (not shown) for fitting the car cage acceleration sensor 12 on the car cage 6, a lack of the rigidity of bolts for fitting members and the car cage 6 together, a lack of the rigidity of members constituting the car frame 5, a lack of the rigidity of a member (not shown) for fitting the car frame acceleration sensor 11 on the car frame 5, a lack of the rigidity of bolts for fitting members and the car frame 5 together, and the like.

These vibration modes and other vibration modes cannot all be modeled, and there is bound to be a difference between an actual machine and a model used for control design. This difference is generally referred to as a modeling error. It is also one of the important objects of the controller 13 to ensure stability for such a modeling error.

Figure 7:
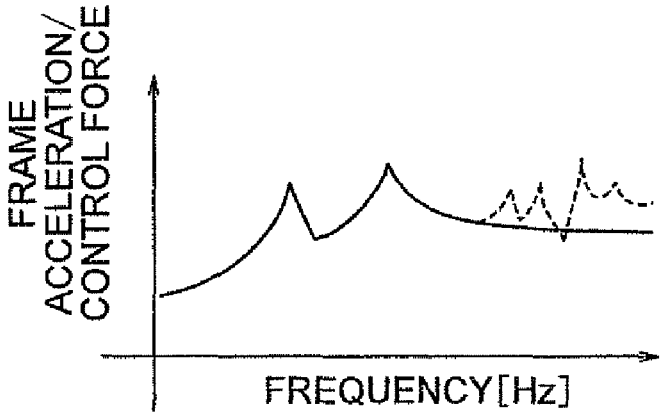
FIG. 7 is a Bode diagram showing a frequency transfer characteristic from a control force applied by each actuator of FIG. 1 to an acceleration of a car frame.

FIG. 7 is a Bode diagram showing a frequency transfer characteristic from a control force applied by each of the actuators 10 of FIG. 1 to an acceleration of the car frame 5. Referring to FIG. 7, a solid line indicates a transfer characteristic of the simplified model shown in FIG. 3. Broken lines indicate a transfer characteristic in an actual elevator. As shown in FIG. 7, although the transfer characteristic of the simplified model substantially coincides with that of the actual machine in a low-frequency range, there is an error created therebetween in a high-frequency range. This error results from a large number of unmodeled vibration modes as described above.

Figure 8:
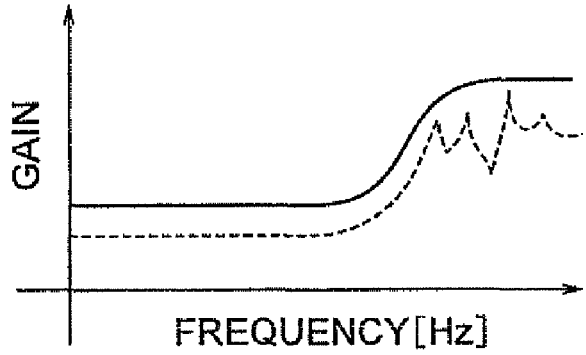
FIG. 8 is a Bode diagram showing a characteristic of a modeling error and a characteristic of a weighting function.

An error $\Delta_{s2}$ between a transfer characteristic $P_r$ of the actual machine and a transfer characteristic $P_m$ of the simplified model is assumed to be expressed as $P_r=(I+\Delta_{s2})P_m$. In this case, $\Delta_{s2}$ represents an error of a multiplicative nature and hence is generally referred to as a multiplicative error. Broken lines of FIG. 8 indicate a frequency characteristic of the multiplicative error $\Delta_{s2}$.

Figure 9:
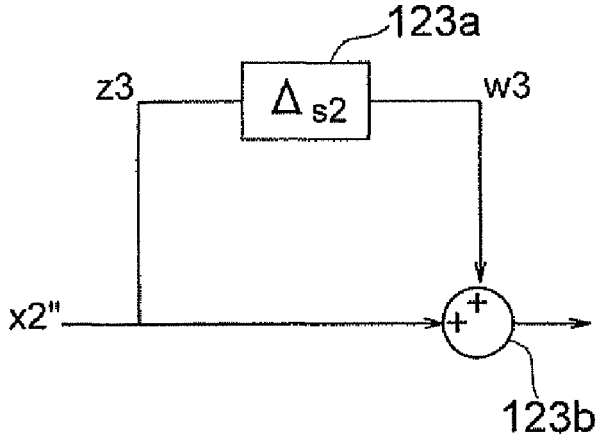
FIG. 9 is a block diagram showing a modeling error in a high frequency range.

According to representation in the form of a block diagram, the multiplicative error $\Delta_{s2}$ is inserted as shown in FIG. 9 between a car frame acceleration x2" and the controller block 113, which are shown in FIG. 4. Referring to FIG. 9, a block 123*a* is a modeling error block. A block 123*b* is an adder. A sufficient condition for ensuring stability for the above modeling error $\Delta_{s2}$ is expressed by the following expression, using the theorem of small gain.

$$\|G_{z3w3}\Delta_{s2}\|_\infty<1 \tag{9}$$

It should be noted that $G_{z3w3}$ represents a transfer function from w3 to z3 at the time of detachment of an output end of the modeling error block 123*a* in FIG. 9. In general, however, the modeling error $\Delta_{s2}$ cannot be modeled with accuracy. Therefore, as indicated by a solid line of FIG. 8, a weighting function $W_{s2}$ having the property of covering the modeling error $\Delta_{52}$ is used to designate the following expression as a sufficient condition for stability. It should be noted that $\delta_{s2}$ is a perturbation element fulfilling an inequality: $|\delta_{s2}|<1$.

$$\|W_{s2}G_{z3w3}\delta_{s2}\|_\infty<1 \tag{10}$$

As is apparent from the foregoing description, it is one of the design objectives of the controller 13 to fulfill the expression (10).

By the same token, the following expression is derived as a sufficient condition for stability for a modeling error $\Delta_{s1}$ in an acceleration detecting region of the car cage 6. It should be noted that $W_{s1}$ is a weighting function having the property of covering the modeling error $\Delta_{s1}$, that $G_{z4w4}$ is a transfer function defined at an acceleration end of the car cage which is defined in the same manner as in FIG. 9, and that $\delta_{s1}$ is a perturbation element fulfilling an inequality: $|\delta_{s1}|<1$.

$$\|W_{s1}G_{z4w4}\delta_{s1}\|_\infty<1 \tag{11}$$

The design objective expression (4) is treated in the same manner as the expressions (6), (8), (10), and (11) and hence is replaced with the following expression through the introduction of a fictitious perturbation element $\delta_v$ ($|\delta_v|<1$).

$$\|W_sG_{x1x0}\delta_v\|_\infty<1 \tag{12}$$

To sum up, the specification required of the controller 13 fulfills the design objective expressions (6), (8), (10), (11), and (12) for the perturbations $\delta_{m1}$, $\delta_{k1}$, $\delta_{s1}$, $\delta_{s2}$, and $\delta_v$ resulting from uncertainty in the parameters, modeling errors, and the like. For these perturbations, a structured singular value $\mu$ is defined as expressed by the following expression.

$$\mu_\Delta(M)\equiv 1/\min\{\bar{\sigma}(\Delta):\det(I-M\Delta)=0\} \tag{13}$$

It should be noted that Δ is a matrix having the perturbation elements $\delta_{m1}$, $\delta_{k1}$, $\delta_{s1}$, $\delta_{s2}$, and $\delta_v$ as diagonal sections, and that M is a matrix having all the inputs and outputs except the perturbation elements on each of the left sides of the design objective expressions (6), (8), (10), (11), and (12) (e.g., the input and output of $W_{s2}G_{z3w3}$ in the expression (10)). It should also be noted that det represents a determinant. Using the expression (13), a sufficient condition for fulfilling all the design objective expressions (6), (8), (10) (11), and (12) can be expressed by the following expression.

$$\mu_\Delta(M)<1 \tag{14}$$

That is, by determining the controller 13 in such a manner as to fulfill the expression (14), a stable elevator with weak lateral vibrations can be provided even in the presence of uncertainty in the mass of the car cage, uncertainty in the rigidity of each of the vibration-proof members 7, and a modeling error in a high-frequency range.

In actually designing the controller 13, for reasons of fulfillment of mathematical solvable conditions and the like, other objective expressions may be added as conditions to the design objective expressions (6), (8), (10), (11), and (12). As conditions on uncertainty in the parameters, for example, uncertainty in the mass of the car frame 5, uncertainty in the rigidity of the spring 20, damping uncertainty of each of the vibration-proof members 7, damping uncertainty of the spring 20, and the like may be taken into account in addition to uncertainty in the mass of the car cage 6 and uncertainty in the rigidity of each of the vibration-proof members 7. The same way of thinking as described above holds true in this case as well. This case can be handled within the framework of the structured singular value.

Figure 10:
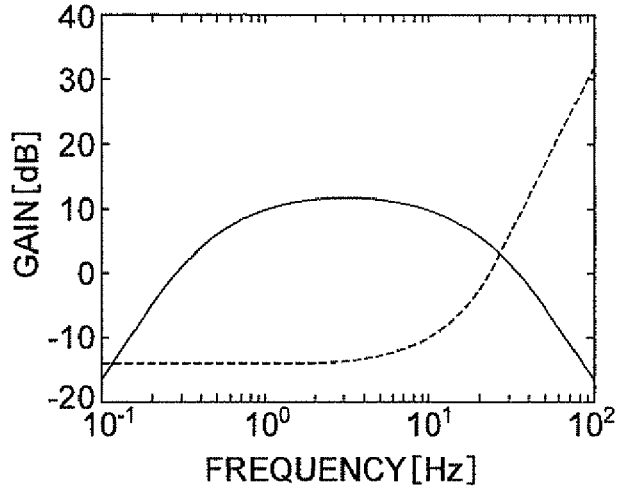
FIG. 10 is a Bode diagram showing a characteristic of a weighting function.

An effect achieved in the case where the present technology is adopted for the model shown in FIGS. 3 and 4 will be described using actual calculation results. The parameters of the elevator running at high speed are set, for example, such that m1=2000 to 4000 [kg], that m2=4000 [kg], that k1=1.0e6 to 2.0e6 [N/m], that k2=4.0e5 [N/m], and that c1=c2=2.0e4 [Ns/m]. The weighting function $W_s$ is given as indicated by a solid line of FIG. 10, and the weighting functions $W_{s1}$ and $W_{s2}$ are given as indicated by broken lines of FIG. 10. As is apparent from the weighting functions $W_{s1}$ and $W_{s2}$, about ten times as large a modeling error is permitted in the neighborhood of, for example, 50 to 60 Hz.

Figure 11:
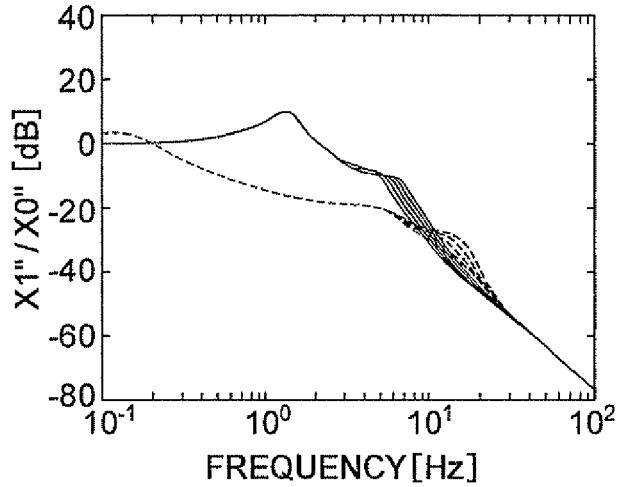
FIG. 11 is a Bode diagram showing a transfer characteristic from an acceleration disturbance of each guide rail to an acceleration of the car cage.

FIG. 11 shows a transfer characteristic from an acceleration disturbance x0" of each of the guide rails 2 to an acceleration x1" of the car cage. Referring to FIG. 11, a solid line indicates a characteristic in the case where the controller 13 designed to fulfill the expression (14) is applied (which is equal to $G_{x1x0}$ of the expression (12)), and broken lines indicate a characteristic in the case where the controller 13 is not employed. FIG. 11 illustrates a case where the rigidity of each of the vibration-proof members 7 is changed in five stages from an envisaged minimum value to an envisaged maximum value. As shown in FIG. 11, through application of the controller 13, high disturbance suppression performance accompanied with stability is achieved even when the rigidity of each of the vibration-proof members 7 fluctuates.

Figure 12:
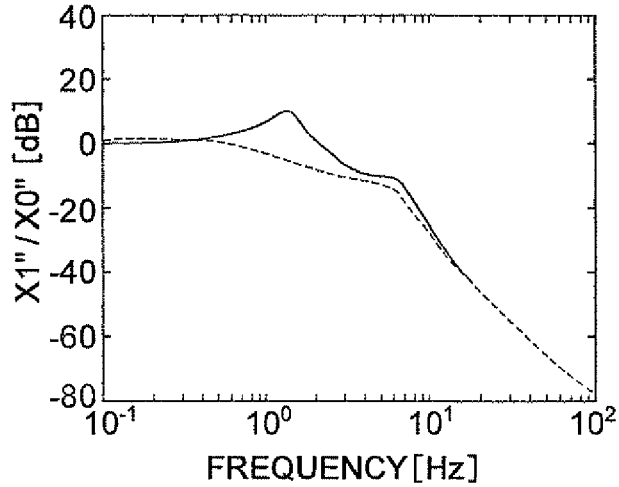
FIG. 12 is a Bode diagram showing a transfer characteristic from an acceleration disturbance of each guide rail to an acceleration of the car cage in the case where only the acceleration of the car frame is detected.

FIG. 12 shows a transfer characteristic in the case where only the acceleration of the car frame 5 is detected as is the case with conventional technologies. Referring to FIG. 12, a solid line indicates a case where no control is performed, and broken lines indicate a case where control is performed. There is an unobservable frequency in the neighborhood of a second-order vibration mode. Therefore, while first-order vibrations are well suppressed, second-order vibrations can hardly be suppressed. Even in the case where the acceleration sensor 11 is provided only on the car frame 5, further improvements in vibration suppression performance can be made if the designing based on the aforementioned structured singular value is carried out. However, such improvements can be made in the case where neither the rigidity of each of the vibration-proof members 7 nor the mass of the car cage 6 fluctuates. In the case where uncertainty in these parameters is taken into account, an extreme deterioration in vibration suppression performance is observed unless the acceleration sensor 12 is provided on the car cage 6.

That is, a vibration damping device for an elevator which exhibits stability and high vibration suppression performance for uncertainty in parameters can be obtained by providing the acceleration sensor 12 on the car cage 6 as well and carrying out the designing based on the structured singular value.

Figure 13:
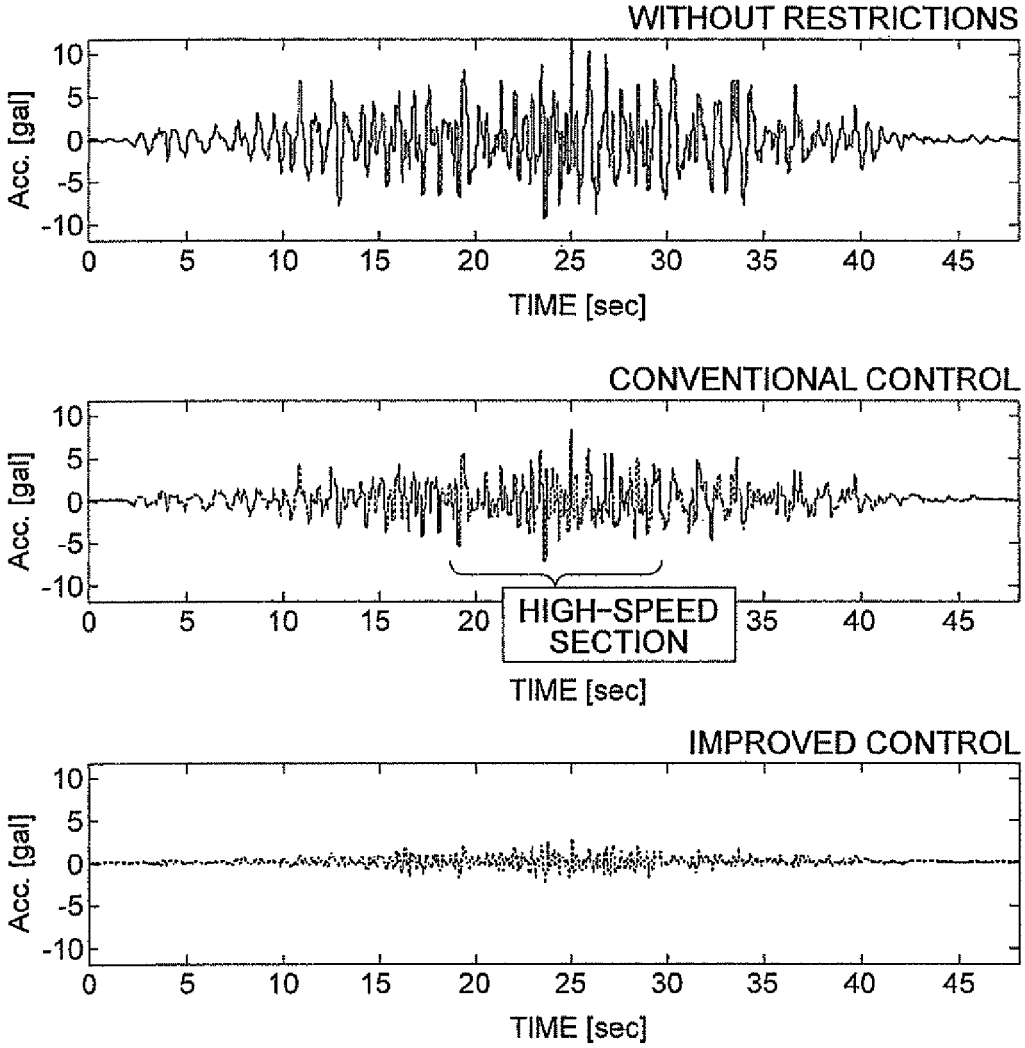
FIG. 13 is an explanatory diagram showing time history waveforms of the car cage in the case where a guide rail disturbance is caused during high-speed running.

FIG. 13 shows time history waveforms of the car cage 6 in the case where a guide rail disturbance is actually given while the elevator car 4 runs at a maximum speed of 1,000 [m/min] or higher. The upper stage of FIG. 13 shows the waveform of the acceleration of the car cage 6 in the case where no control is performed, and the middle stage of FIG. 13 shows the waveform of the acceleration of the car cage 6 in the case where conventional control is performed using only the acceleration of the car frame 5. Further, the lower stage of FIG. 13 shows the waveform of the acceleration of the car cage 6 in the case where the control according to Embodiment 1 of the present invention is performed.

For a while after the start of the elevator car, the excitation frequency of the guide rail disturbance, which is determined by the expression (1), is low, so relatively good vibration damping performance is achieved even through conventional control. However, when the running speed of the elevator car 4 increases, the excitation frequency of the guide rail disturbance becomes high, so vibrations cannot be sufficiently damped through conventional control. On the other hand, excellent vibration damping performance can be continuously achieved from the start of running of the elevator car 4 to the stop of running thereof through the control according to Embodiment 1 of the present invention.

Embodiment 2

Next, Embodiment 2 of the present invention will be described. As described in Embodiment 1 of the present invention, there is a vibration mode that cannot be modeled in a high-frequency range in an actual elevator. Therefore, sufficient improvements in vibration suppression performance cannot be made with ease in a high-frequency range of 10 Hz or higher. On the other hand, a vibration mode in which the spring 20 or each of the vibration-proof members 7 is at the peaks of vibrations is desired to be damped positively.

Incidentally, the rigidity of the spring 20 or each of the vibration-proof members 7 is determined from the standpoint of not only the damping of vibrations but also a support mechanism for supporting the car frame 5 and the car cage 6, and hence cannot be lowered drastically. In particular, the vibration-proof members 7 need to support the car cage 6 in the vertical direction when passengers get on and off the car cage 6, and thus require a certain level of rigidity in the vertical direction.

In general, in the case where, for example, rubber is used as a material of the vibration-proof members 7, an increase in the rigidity of each of the vibration-proof members 7 in the vertical direction leads to an increase in the rigidity thereof in the horizontal direction as well. As a result, the frequency in the mode in which each of the vibration-proof members 7 is at the peak of vibration becomes high and close to a frequency range where there is a modeling error. In such a state, high vibration suppression performance cannot be achieved with ease even when the acceleration sensor 12 is provided on the car cage 6 to perform the control according to Embodiment 1 of the present invention.

Figure 14:
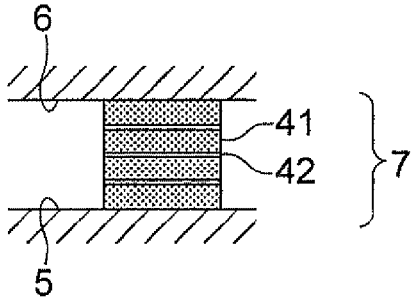
FIG. 14 is a front view showing a vibration-proof member of a vibration damping device for an elevator according to Embodiment 2 of the present invention.

Thus, in Embodiment 2 of the present invention, as shown in FIG. 14, a laminate rubber piece obtained by alternately laminating a plurality of rubber portions 41 and a plurality of steel sheet portions 42 is used as each of the vibration-proof members 7. By adopting this construction, each of the vibration-proof members 7 exhibits high rigidity in a compressing direction thereof but relatively low rigidity in a shearing direction thereof. Accordingly, each of the vibration-proof members 7 exhibits high rigidity in the vertical direction and low rigidity in the horizontal direction, so the frequency in the mode in which each of the vibration-proof members 7 is at the peak of vibration does not reach the range of the modeling error. Thus, high vibration suppression performance can be achieved through the method of control described in Embodiment 1 of the present invention.

In each of the foregoing examples, only the damping of lateral vibrations of the elevator car 4 is described. However, longitudinal vibrations of the elevator car 4 can also be damped in the same manner.

Further, in each of the foregoing examples, the actuators 10 are provided only on the lower portion of the car frame 5. However, the actuators 10 may be provided on the roller guide devices 9 on the upper and the lower portions of the car frame 5, respectively, or only on the roller guide devices 9 on the upper portion of the car frame 5, respectively.

Furthermore, in Embodiment 2 of the present invention, the rubber portions 41 and the steel sheet portions 42 are combined to be used as a material of each of the vibration-proof members 7. However, the material of each of the vibration-proof members 7 is not limited to rubber and steel sheets. Other two or more kinds of the materials that are different in rigidity from one another may be suitably selected and laminated such that each of the vibration-proof members 7 becomes smaller in rigidity in the horizontal direction than in the vertical direction.

The invention claimed is:

1. A vibration damping device for an elevator, comprising:

a car frame acceleration sensor for detecting horizontal acceleration of a car frame of an elevator car;

a car cage acceleration sensor for detecting horizontal acceleration of a car cage of the elevator car;

an actuator provided in parallel with a spring mounted on the car frame for urging a guide roller against a guide rail installed in a hoistway and for generating a vibration damping force applied to the elevator car; and a controller for determining a vibration damping force generated by the actuator based on information from the car frame acceleration sensor and information from the car cage acceleration sensor, thereby controlling the actuator.

2. The vibration damping device for an elevator according to claim 1, wherein the car cage is supported by the car frame via a vibration-proof member, and a transfer characteristic from outputs of the car frame acceleration sensor and the car cage acceleration sensor to the vibration damping force of the actuator is determined such that a structured singular value for structuralization perturbations, including at least one of a perturbation for uncertainty in mass of the car cage, a perturbation for uncertainty in rigidity of the vibration-proof member, a high-frequency range perturbation resulting from lack of rigidity of the car cage, and a high-frequency range perturbation resulting from lack of rigidity of the car frame, remains smaller than 1 in all frequency ranges.

3. The vibration damping device for an elevator according to claim 2, wherein the vibration-proof member is smaller in rigidity in a horizontal direction than in a vertical direction of the vibration-proof member.

4. The vibration damping device for an elevator according to claim 3, wherein the vibration-proof member comprises a laminated rubber piece including a plurality of alternately laminated rubber portions and steel sheet portions.

* * * * *